US005794532A

United States Patent [19]

Gassies et al.

[11] Patent Number: 5,794,532

[45] Date of Patent: Aug. 18, 1998

[54] GAMBLING CHIP AND METHOD OF MARKING SAME

[75] Inventors: Christophe Gassies, Echevronne; Olivier Mauzac, Seppois-le-bas; Eric Philippe, Grans, all of France

[73] Assignee: Etablissements Bourgogne et Grasset, Savigny-les-Beaune, France

[21] Appl. No.: 942,283

[22] PCT Filed: Feb. 13, 1996

[86] PCT No.: PCT/FR96/00228

§ 371 Date: Oct. 2, 1996

§ 102(e) Date: Oct. 2, 1996

[87] PCT Pub. No.: WO96/25066

PCT Pub. Date: Aug. 22, 1996

Related U.S. Application Data

[63] Continuation of Ser. No. 718,572, Oct. 2, 1996.

[30] Foreign Application Priority Data

Feb. 15, 1995 [FR] France ..... 95 01728

[51] Int. Cl.[6] ..... B41F 31/00

[52] U.S. Cl. ..... 101/493; 273/148 R; 283/67; 283/94; 283/107; 427/258

[58] Field of Search ..... 101/483, 493, 101/163, 170; 156/302.1; 340/372; 427/277, 198, 258; 283/67, 72, 82, 94, 107, 87; 273/148 R, 139; 235/492

[56] References Cited

U.S. PATENT DOCUMENTS

| | | | |
|---|---|---|---|
| 1,475,652 | 11/1923 | Polizzi | D21/1 |
| 3,766,452 | 10/1973 | Burpee et al. | 283/82 |
| 3,904,791 | 9/1975 | Iverson et al. | 427/277 |
| 3,916,784 | 11/1975 | Dubuit | 101/163 |
| 3,953,932 | 5/1976 | Graves | 156/303.1 |
| 3,968,582 | 7/1976 | Jones | 273/148 R |
| 4,019,436 | 4/1977 | Handweiler et al. | 101/463 |
| 4,078,482 | 3/1978 | Goerig et al. | 101/493 |
| 4,163,813 | 8/1979 | Sheets et al. | 427/198 |
| 4,435,911 | 3/1984 | Jones . | |
| 4,508,031 | 4/1985 | Rajnik | 101/493 |
| 4,530,286 | 7/1985 | Samuels | 101/163 |
| 4,726,006 | 2/1988 | Benne . | |
| 4,747,093 | 5/1988 | Benne . | |
| 4,814,589 | 3/1989 | Storch | 235/454 |
| 4,889,366 | 12/1989 | Fabbiani . | |
| 4,925,705 | 5/1990 | Hill | 101/493 |
| 5,166,502 | 11/1992 | Rendleman et al. | 235/492 |
| 5,228,692 | 7/1993 | Carrick et al. | 273/139 |
| 5,361,885 | 11/1994 | Modler . | |
| 5,403,039 | 4/1995 | Barowske et al. | 283/87 |
| 5,406,264 | 4/1995 | Plonsky et al. | 340/572 |
| 5,466,010 | 11/1995 | Spooner | 283/67 |

FOREIGN PATENT DOCUMENTS

| | | |
|---|---|---|
| 0083808 | 7/1983 | European Pat. Off. . |
| 0197590 | 10/1986 | European Pat. Off. . |
| 0251253 | 1/1988 | European Pat. Off. . |
| 0337921 | 10/1989 | European Pat. Off. . |
| 0365018 | 4/1990 | European Pat. Off. . |
| 0375062 | 6/1990 | European Pat. Off. . |
| 2076338 | 12/1981 | United Kingdom . |
| 8700796 | 2/1987 | WIPO . |
| WO93/08565 | 4/1993 | WIPO . |
| WO93/22746 | 11/1993 | WIPO . |

OTHER PUBLICATIONS

A Japanese Patent Abstract of JP 63–280639, published Nov. 17, 1988.

A Japanese Patent Abstract of JP 60–030344, published Feb. 15, 1985.

*Primary Examiner*—Eugene H. Eickholt

*Attorney, Agent, or Firm*—Greenblum & Bernstein, P.L.C.

[57] ABSTRACT

A gambling chip includes a decorative pattern provided on at least one side thereof and on an edge thereof. The pattern is formed by pressure pad marking, i.e., applying an ink pattern to a deformable head and stamping the pattern on the chip. Repeated stamping of different color inks can create different patterns. A layer of varnish is also applied to the chip, either between ink layers or above or below all of the ink layers.

31 Claims, 2 Drawing Sheets

GAMBLING CHIP AND METHOD OF MARKING SAME

Figure 1:
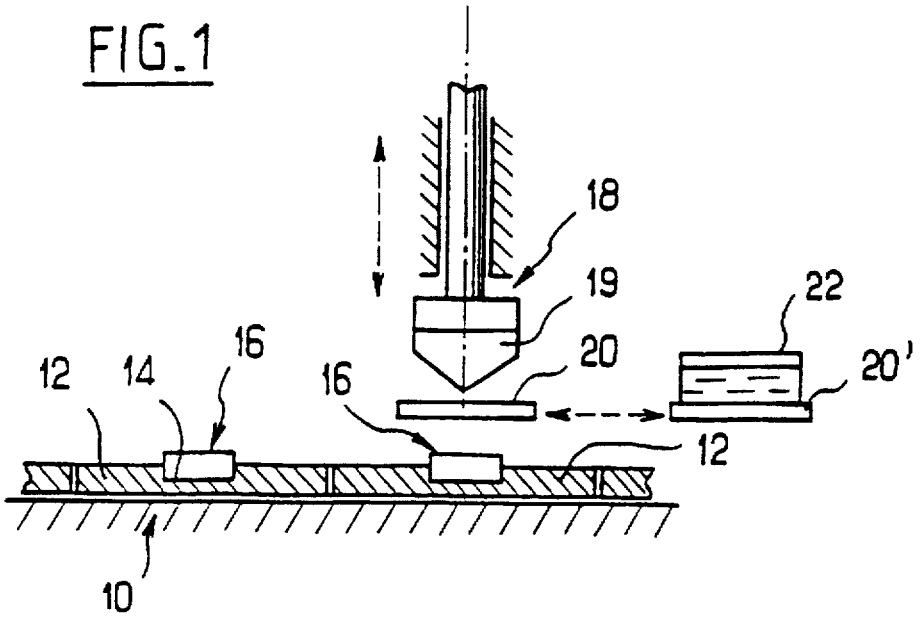

This application is a continuation of application Ser. No. 08/718,572, filed Oct. 2, 1996, pending.

BACKGROUND OF THE INVENTION

1. Field of the Invention

The present invention relates to gambling chips also called casino chips. By gambling chip is meant any element which can be used in gambling halls and representing a predetermined or non-predetermined nominal value, whether it is an actual chip in the form of a disc or a gambling tile generally representing a high stake. These chips are classified, depending on the type of game for which they are used, into two families—"French or European" chips with or without a predetermined value and "American" chips with or without a predetermined value. In general, these chips are manufactured from rigid plastic which is soiling resistant and scratch resistant.

2. Description of Background and Relevant Information

Gambling chips are subjected, in a quasi-systematic way, to a decoration by marking their faces and/or edges and which, depending on the eventual uses of the chips, can range from the simplest to the most complex. In the remainder of the account, the term decoration encompasses its widest meaning and comprises especially any design, sign, mark and character (for example letters and numerals) capable of graphical representation and/or of visual effect. More precisely, the decoration of the chips is capable of fulfilling at least one of the many functions presented briefly below:

i) a function of identification of the casino and/or the gambling table and/or the player;
ii) a function of identification of the value represented by the chip;
iii) a function of decoration having an aesthetic character and/or of an advertising medium; and
iv) a function of security against the risk of fraudulent manufacture and/or reproduction.

As regards the marking proper, it is possible to distinguish thickness or volume marking (for example marking within the bulk with or without insert, etching, etc.) from the marking of a surface (for example printing using monochrome or polychrome screen printing). The invention relates more particularly to surface marking, it being understood that surface marking can be carried out on a surface within the very chip (for example for "European" chips and tiles produced in the form of laminated plastic sheets).

Among surface marking techniques for gambling chips, hot marking is known, this being used most often for simple and monochrome decorations. In this technique, an inking ribbon carrying an ink of predetermined colour is placed on one face of the chip, the marking being carried out by a hot punch carrying the decorative pattern. This technique, being very limited because of the monochrome nature of the ribbons and because of the low degree of complexity of the visual appearances achievable by using a punch, can only be used on plane objects (having no relief) for fear of incomplete marking on the chips. It should be noted that, in addition to the high tooling costs and the quite lengthy manufacturing times, this technique not allowing the use of UV-detectable ink.

A higher-performance technique, called "sublimation" technique, is also used for marking the chips. According to this technique, a transfer on which the decoration (which may be polychrome) has been produced is deposited on the chip. Through the action of heat, the ink from the transfer is sublimed, ending up by being deposited on the external surface of the chip and migrating into the material to a depth of a few tens of microns.

This technique gives better results than the previous technique but suffers from major limitations, especially as regards:

the need to carry out the sublimation on a white-coloured plastic carrier in order to avoid deviation of the colours sublimed;
the impossibility of using metallic (gold or silver) inks;
the impossibility of subliming the colour white;
the impossibility of using gloss printing over the entire carrier; and
the great difficulty of obtaining strong colours. In addition, this technique remains expensive.

Another technique also used for the surface marking of gambling chips consists in printing a decoration (for example by screen printing) on the inner face of an wafer made of transparent or translucent plastic, either smooth or with a granite finish, (for example made of polycarbonate), which is then adhesively bonded in the bottom of a corresponding cavity provided on one face of the chip. However, this technique is also fairly expensive and is not entirely satisfactory as regards the risk of fraudulent substitution of the marked wafer. It is also sensitive to dirt particles which get in under the wafer or into the wafer/chip interstice.

As a result of the foregoing, there exists a need for a new method of marking gambling chips which eliminates or substantially reduces the limitations and other drawbacks of the methods presented above. In addition, the final decoration of the chip must in general exhibit good wear resistance in order to take into account the often harsh conditions under which a gambling chip is used, due especially to the frequent handling of casino chips on the gambling tables or during operations of counting, sorting or washing the chips.

SUMMARY OF THE INVENTION

According to the invention, the gambling chip or a similar device is characterized in that at least one of its faces or its edge includes a decoration produced by at least one ink-based pressure-pad marking operation and combined with at least one layer of varnish.

Apart from its obvious economic aspect, marking gambling chips by pressure-pad marking turns out to be easily adaptable to the various types of chips to be marked, in particular chips with a relief (by virtue of the ability of the pad to deform), especially for "European" chips, some of which have moulding notches. This facilitates full-face marking. Pressure-pad marking also allows direct marking on the edge of the chip (for example the marking of a bar code), something which cannot be achieved today using the other surface marking techniques mentioned hereinabove.

In addition, combining a varnish with the decoration makes it possible to obtain visual effects and/or to provide the necessary physical protection of the decoration. As explained in detail hereinbelow, the layer of varnish is combined with the decoration in several ways: i) by placing the layer of varnish as the outer cover of the decoration; ii) by placing the layer of varnish internally with respect to the decoration; iii) by producing the decoration from an ink/varnish mixture. In particular, among the advantages provided by the deposition of a covering varnish, mention may be made of the better wear and scratch resistance and the good protection against falsification. Advantageously, the surface of the decoration (ink or varnish) has non-stick properties preventing fraudulent overmarking.

According to a first embodiment of the invention, the decoration is produced by pressure-pad marking in polychrome, especially using inks which are to a greater or lesser extent transparent. As will be apparent in the description hereinbelow, the final colour image of the decoration obtained by pressure-pad marking consists of the complementary addition of monochrome images, each of these monochrome intermediate images being etched on plates. After inking the plates, a pad, by being pressed, picks up the ink from these plates and deposits it completely by pressing on the chip to be marked. Advantageously, the marking of the decoration by pressure-pad marking is preceded by the deposition, possibly by pressure-pad marking, of a finish layer in order to improve the surface finish of the carrier of the pressure-pad marked decoration.

According to a variant of the invention, which is also advantageous from the security standpoint, the decoration obtained by pressure-pad marking is produced using at least one ink or varnish detectable under ultraviolet radiation.

According to another variant, the decoration obtained by pressure-pad marking is produced using at least one layer of an ink/varnish mixture. This characteristic makes it possible, inter alia, to obtain a glossier marking and to harden the layer forming the decoration.

According to yet another variant, the marking of the decoration is obtained by at least one ink-based pressure-pad operation producing a visual effect or a pattern by means of at least one layer of varnish deposited by pressure-pad marking either over the surface of the marking or between two layers of printing of the latter. The pattern may be deposited over the entire decoration (for example a checkerboard) or over part of the decoration (marking the name of the casino with a varnish which is to a greater or lesser extent glossy and/or UV-detectable).

According to yet another variant, the decoration obtained by pressure-pad marking is produced partly by one or more layers of varnishes having a varied visual appearance, these varnishes being chosen from matt varnish, gloss varnish, tinted varnish, varnish with an iridescent appearance, varnish with a nacreous appearance, varnish with a flaky appearance, varnish with a granite-like appearance, varnish with an aged appearance and varnish with a crazed appearance. This technique enables the decoration to have a particular visual appearance and provides good protection against fraudulent reproduction.

According to another embodiment of the invention, at least one face of the chip has one edge with a softened profile, such as a chamfer or a rounded edge, the edge with a softened profile being marked by pressure-pad marking using the same operation for marking the face so as to mark at least part of the edge of the chip simultaneously. By virtue of this arrangement, it is possible to mark both faces and the edge of the chip in two operations instead of three.

According to yet another embodiment of the invention, at least one of the faces of the chip of the substantially plane-faced type has at least one substantially flat-bottomed cavity carrying all or part of the decoration produced by pressure-pad marking. Advantageously, the outer part of the edge of the cavity has a chamfer limiting the deposition and sticking of dirt particles on the central part of the chip and making it easier to mark the periphery of the cavity using the inking pad.

According to another embodiment of the invention, the layer of varnish combined with the decoration is deposited as a covering of the said decoration obtained by pressure-pad marking and has a thickness at least equal to 20 μm. Preferably, the covering layer of varnish preferably has a thickness of between 50 and 100 μm, thus providing the decoration with a protective layer of high mechanical strength. In practice, the covering layer of varnish is deposited on the said decoration by spraying, dipping, or drop- or curtain-deposition.

According to another variant, the covering layer of varnish consists of one or more synthetic resins filled with a powder of hard materials, for example silica-based materials. According to another variant, the covering layer of varnish consists of one or more synthetic resins filled with materials giving the varnish non-slip properties, for example elastomer-based or wax-based materials.

According to yet another variant of the invention, the laying-down of the covering layer of varnish on the decoration is preceded by an operation of coding and/or numbering the chip, incremental or not, by ink-jet or laser printing, hot marking, or pressure-pad marking on top of the decoration.

Of course, the invention also relates to the method of marking, by pressure-pad marking, at least one of the faces or the edge of a gambling chip and the application of the pressure-pad marking to the marking in general and to the decoration of gambling chips.

More particularly, according to one particular way of implementing the invention, at least one of the faces or the edge of a gambling chip or similar device is marked using at least one operation of ink-based pressure-pad marking combined with laying down at least one layer of varnish.

According to a variant of the method according to the invention, the decoration is marked using at least one ink-based pressure-pad marking operation and then the said decoration is covered by at least one layer of varnish deposited by pressure-pad marking, spraying, dipping or drop- or curtain-deposition.

According to another variant, a decoration is marked using at least one pressure-pad marking operation using an ink/varnish mixture.

According to yet another variant, a decoration is marked partly by pressure-pad marking with one or more layers of varnishes of varied visual appearance, these varnishes being chosen from matt varnish, gloss varnish, tinted varnish, varnish with an iridescent appearance, varnish with a nacreous appearance, varnish with a flaky appearance, varnish with a granite-like appearance, varnish with an aged appearance and varnish with a crazed appearance.

According to yet another variant, the marking with a decoration is carried out using at least one ink-based pressure-pad marking operation producing a visual effect or of a pattern by means of at least one layer of varnish deposited by pressure-pad marking either over the surface of the decoration or between two layers of ink-based printing of the decoration.

Apart from gambling chips, the invention is applicable to devices which are similar in terms of their structures, their end uses and their conditions of use, such as prepayment tokens, access tokens and/or cards, countermarks, etc.

BRIEF DESCRIPTION OF THE PREFERRED EMBODIMENTS

Figure 3A:
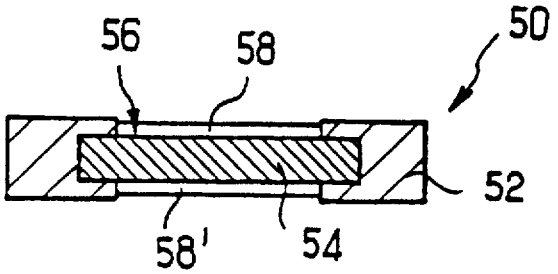
Figure 3B:
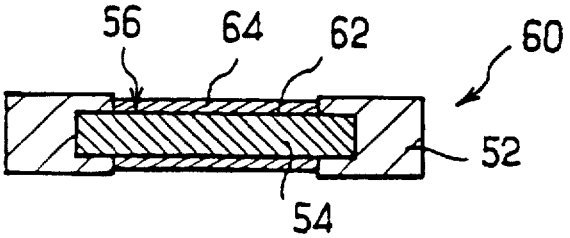
Figure 3C:
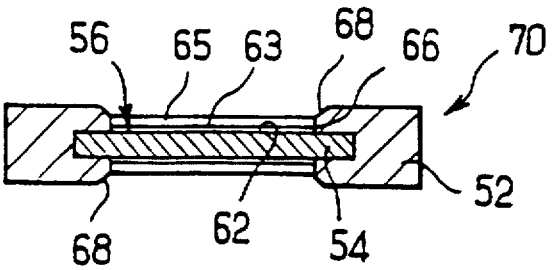
Figure 2A:
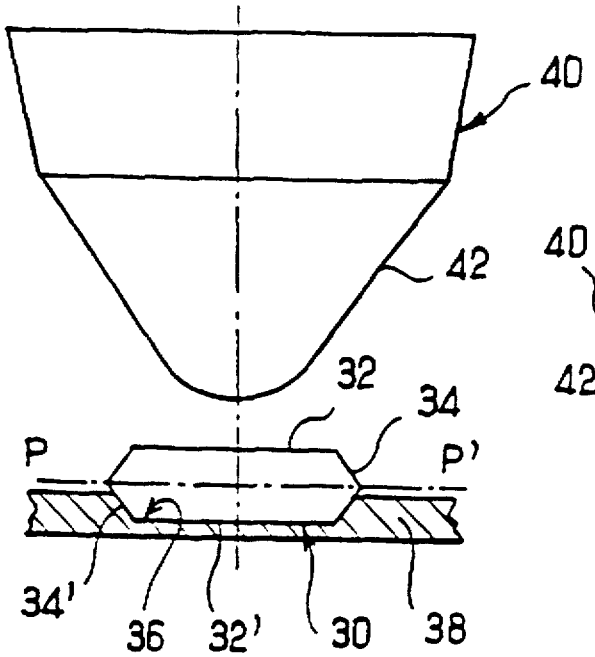
Figure 2B:
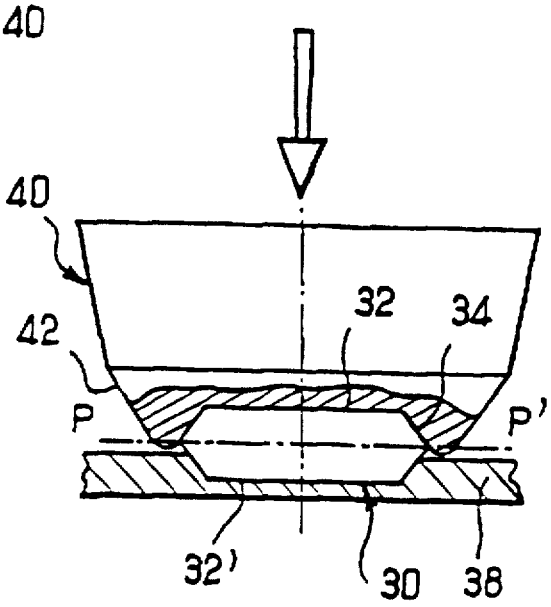

Other characteristics and advantages of the present invention will appear on reading the following description, with reference to the herein-appended drawings in which:

FIG. 1 represents a drawing showing the basic principle of a pressure-pad marking installation enabling the invention to be implemented;

FIGS. 2*a* and 2*b* represent an operation of marking a gambling chip according to the invention with a chamfered edge by pressure-pad marking, respectively before marking (FIG. 2*a*) and during marking, showing the compressed pad (FIG. 2*b*); and FIGS. 3*a*, 3*b*, 3*c* represent the diametral cross-sections of three metal-insert chips ("American" chips); in particular FIG. 3*a* relates to a printed tablet and FIGS. 3*b* and 3*c* relate to two variants of chips marked by pressure-pad marking according to the invention.

The marking of at least one of the faces of a gambling chip by pressure-pad marking is capable of being implemented using various types of machines or installations. By way of non-limiting example, FIG. 1 illustrates the principle of such an installation for implementing the invention.

Referring to FIG. 1, the reference 10 represents a horizontal frame on which a tape moves in a stepwise movement, each section 12 of which tape is provided with a recess 14 intended to receive a chip 16 to be marked (the face to be marked being slightly proud of the surface of the section 12 of the tape). By way of non-limiting example, the plane-faced chip 16 is produced by the injection moulding of a plastic. In some installations, not shown, the tape divided into sections 12 is replaced by a rotating platform or carousel. The chips 16 pass in succession past an inking pad 18 which can move in reciprocating vertical movements. The pad 18 has a deformable head 19 made of synthetic material (siliconized material), in this case having a conical end. A plate holder 20 can also move reciprocatingly between being vertically in line with the pad 18 (position 20) and being vertically in line with an ink reservoir 22 (position 20'). The operation of pressure-pad marking proper is carried out in the following way. After inking the plate (position 20'), the plate holder is moved into the position 20. A first downward vertical movement of the pad 18 enables the ink (or the varnish) to be picked up simply by pressing. After raising the pad 18 and withdrawing the plate holder (to the position 20'), the pad 18 is subjected to a second downward vertical movement in order to deposit the ink (or the varnish) simply by pressing on the opposite face of the chip 16 to the one to be marked. In this way, the marking of a (final or intermediate) monochrome image is produced.

Without departing from the scope of the invention, other installations use a plate holder which is fixed level with the inker and a sliding pad which strikes the inker and is capable of a second vertical reciprocating movement in order to mark the product. Likewise, use is made of pressure-pad marking inkers which are open or closed (in this case in order to limit the drying-out of the inks and varnishes).

For polychrome marking, the final image of the decoration consists of the complementary addition and/or superposition of single-colour images, each of these intermediate images being etched on separate plates. For polychrome marking, either several movable plate holders or a series of monochrome pressure-pad marking units are used. In general, the inks are very fluid, with a certain degree of transparency, and are capable of drying rapidly in order to allow the next operation of marking with another colour without any risk of mixing of the successive printings of different colours (of the order of 2 seconds between two markings).

The inks used are of many colours: for example blue, green, red and black for four-colour marking. Metallic inks are also used, for example metallic grey, in order to give the image special effects: moiré effect, iridescent effect, nacreous effect, etc.

According to a variant of the invention, a layer of varnish is combined with a decoration by producing the decoration by pressure-pad marking using at least one layer-of an ink/varnish mixture, thus making it possible to obtain a glossy and/or more wear-resistant decoration. According to another variant of the invention, matt/glossy patterns are produced by varnish pressure-pad marking (for example solid backgrounds such as checker-boards or inscriptions such as the name of the casino, the value of the chip, etc.), which patterns are very difficult to reproduce by photography (and therefore highly secure). These patterns are produced by the deposition of one or more layers of varnish, by pressure-pad marking, either over the surface of or between two layers of printing of the decoration, these layers of printing being deposited by ink-based pressure-pad marking. Still within the scope of the invention, part of the decoration is produced, in combination with the ink-based pressure-pad marking, by pressure-pad marking with one or more layers of varnishes having varied visual appearance (these probably being different), these varnishes being chosen from matt varnish, gloss varnish, varnish with a nacreous appearance, tinted varnish, varnish with an iridescent appearance, varnish with a granite-like appearance, varnish with a flaky appearance, varnish with an aged appearance and varnish with a crazed appearance. This latter technique alters the visual appearance of the decoration and enables it to be rendered even more complicated.

Of course, pressure-pad marking allows the use of screens on the blocks, being highly beneficial for printing decorations of the "photograph" type. Compared to sublimation and even to screen printing where the screen ruling is limited by problems of compatibility between the screens of the stencils and the screens of the plates, pressure-pad marking makes it possible to use, without any particular difficulty, finely ruled screens, with more than 150 dots per inch, which increases, over and above the quality of the decoration, the security aspect of the chip. In point of fact, the difficulty of reproduction (especially for non-authorized reproductions) increases with a screen ruling.

According to one advantageous embodiment of the invention, the decoration obtained by pressure-pad marking, using at least one ink-based pressure-pad marking operation, is protected by a covering of a protective sheet of varnish, such as a transparent varnish, for example a matt, satin or gloss varnish. In practice, at least one protective layer of varnish having a thickness at least equal to 20 μm is deposited by pressure-pad marking, by spraying, by dipping, by drop- or curtain-deposition. Preferably, the covering layer of varnish has a thickness of between 50 and 100 μm in order to ensure good wear resistance and soiling resistance. Dipping, spraying or curtain deposition is well suited to covering a decoration extending over a full face of a chip (for example the plane-faced chips 16 called "full-face" decoration chips and the chips 30) while drop deposition is well suited to covering a decoration produced by pressure-pad marking the bottom of a cavity (see for example the cavitied chip illustrated in FIG. 3*b*).

In general, the covering varnishes provide protection with a hardness at least equal to that of the plastic used for the chip (between 70 and 85 Shore D hardness, equivalent to the top of level 2 on the Mohs scale [mineralogist's scale]). However, greater hardnesses may be obtained using UV-curable polyurethane and/or acrylic varnishes or varnishes consisting of one or more synthetic resins filled with a powder of hard materials, for example silica-based materials. Conversely, some covering varnishes consist of one or more synthetic resins filled with materials giving the varnish non-slip properties, for example elastomer- or wax-based materials. In addition, the marking may receive a "non-stick" coating using siliconized or fluorinated (PTFE) inks and varnishes in order to prevent overprinting and other falsifications of the decoration.

According to one variant of the invention, the laying-down of the covering varnish on the decoration of the chip is preceded by an operation of marking with a coding and/or numbering, incremented or not, by ink-jet or laser printing, hot marking or pressure-pad marking on top of the decoration, it being possible for the latter to be obtained using any suitable method (especially decoration of the pressure-pad-marked or hologram type). In practice, it is possible mark, directly on the decoration, with a coding (for example a bar code) or a batch number and/or a serial number according to the requirements of the casino operator (it being possible to increment this number if necessary. This coding and/or this numbering may remain discreet by using UV-detectable ink.

Likewise, in order to increase the security aspect of the markings, some inks (or varnishes) used in pressure-pad marking for the decoration receive pigments capable of being detected under ultraviolet radiation.

In addition, the durability of the decoration obtained by pressure-pad marking can be improved by various techniques, before or after marking, which are tailored to the material carrying the decoration of the chip (synthetic material, metal of the central insert, etc.), for example: before marking, using a mechanical treatment (sand blasting), a chemical treatment (acid), using a physical treatment (CORONA effect or flame brushing); after marking, using a heat treatment, drying, radiation (infrared or UV), or by using polymerizable or sublimable inks (which have the effect of penetrating into the mass of the plastic). In some cases, (marking at the bottom of a cavity, marking on a guilloched surface, planarity adjustment, etc.), it is useful before the pressure-pad marking to deposit, possibly using pressure-pad marking, a primer layer in order to get rid of the surface defects (rugosity or lack of colour uniformity) on the carrier of the decoration and/or to promote the adhesion of the decoration to the chip, and/or to produce a background for the decoration.

Thus pressure-pad marking therefore makes it possible to mark the chips with high quality and with a highly complicated decoration (especially by benefitting from the transparency of the inks and from the matt/gloss appearance of the varnishes) and the possibility of additional security operations, all this by the use of the same basic tooling, the pressure-pad marking unit. This feature, the low tooling costs, the flexibility of the technique and the high output rates obtained using this printing method (up to 3000 chips per hour) thereby make for a very economical method of marking gambling chips. As already mentioned hereinabove, the decoration produced by pressure-pad marking within the scope of the present invention can be from the simplest to the most complicated and consists of drawings, symbols, marks, characters, letters, numbers, bar codes, etc., all these being capable of graphical representation, taken individually or in combination. Of course, symbols obtained, for example, by marking through the mass of the chips (especially by multiple injection of different colours) or by etching may, without departing from the scope of the invention, be added to or superimposed on this decoration produced by pressure-pad marking.

Another very useful property of pressure-pad marking for gambling chips stems from its suitability for marking objects having a degree of relief due to deformation of the pads. In general, the faces of gambling chips are substantially plane, possibly provided with a slight relief (ribs, etching, moulding notches, etc.). It is thus possible to mark these relief-type chips over their entire faces and to do so at the end of manufacturing the chips (without any risk of the decoration being distorted or damaged). This property is also used to make marking of the edge of the chips easier.

Conventionally, the complete marking of a chip is carried out in three printing operations (one per face and one for the edge of the chip). Within the scope of the invention, after printing the faces by pressure-pad marking, as described hereinabove, the edge is printed by lateral marking by the use of a rotary pad (or of a rotary roller pad in the case of simultaneous marking of several chips arranged in a stack). However, still within the scope of the invention, it has proved possible to mark the chip completely by pressure-pad marking in two operations. In order to do this, the edge of at least one face of the chip is modified (with respect to the usual right-angled edge) so as to have a softened profile, such as a chamfer or a rounded edge. FIGS. 2*a* and 2*b* illustrate the marking of a chip 30 (by way of non-limiting example produced from an injected plastic), the two substantially plane faces 32, 32' of which each have a peripheral chamfer 34, 34' (at an angle of approximately 60° with the corresponding face), the chip being moreover symmetric with respect to the horizontal plane PP' parallel to the faces 32, 32'. As may be seen in FIGS. 2*a* and 2*b*, the depth of the recess 36 in the chip-carrying tape 38 is slightly less (by a few tenths of 1 mm) than the half-thickness of the chip 30, thus enabling the conical chamfer 34 to be completely inked when the deformable head 42 of the pad 40 is compressed (with the border 44 of the head 42 extending slightly beyond the mid-plane PP'). Thus, each printing operation therefore enables one face and one half-edge of the chip to be marked.

Apart from marking plane-faced chips, especially, for example, chips with a "full face" decoration, the invention also relates to the marking of chips in which each of the substantially plane faces has a central cavity, usually circular, with a depth of a few tenths of a millimeter, for example injection-moulded one-piece chips or chips obtained by successive injections of plastics of different colours in order to obtain a first multicoloured decoration through the mass of the chip (for example, overmoulding a peripheral ring on a substantially plane central core obtained during the first injection). In general, the pressure-pad marking (and the protective covering by means of a varnish or a wafer) of these chips having cavities without an insert is very similar, if not identical, to the pressure-pad marking described in detail hereinbelow with regard to the marking of chips having cavities with an insert.

Still within the scope of the invention, the pressure-pad marking is used for the marking of chips with an insert (each of the faces of which has a central cavity) and corresponding to the name "American" chip. FIG. 3*a* shows a diametral cross-section (with enlargement in the direction of the thickness in order to make the drawing clearer) of a currently manufactured chip 50. The known chip 50 mainly consists of an annular ring 52 made of plastic (preferably ABS, polystyrene or PMMA [sic]) overmoulded onto a central insert in the form of a disc and forming a ballast 54, for example made of metal (especially steel or brass) in order to define, on each side of the disc, a circular hollowing or cavity 56 of shallow depth (generally of between 0.25 and 0.5 mm). The known chip 50 is completed by putting in place two adhesive labels 58, 58', preferably made of polycarbonate, the inner face of which bears a visual decoration printed by screen printing. It may be noted in FIG. 3*a* that the thickness of the labels is slightly less than the depth of the cavity 56 in order to avoid the decoration being scratched and damaged. It should be noted that, in this type of chip, the ring 52 is very often produced by successive injections of plastics of separate colours in impressions of varied intermediate shapes in order to obtain multicoloured patterns (having from 2 to 5 colours) through the actual mass of the injected material. Consequently, the surface marking involves mainly the central part of the chip.

With regard to FIGS. 3*b* and 3*c*, the chips 60 and 70 have the same substantially plane-faced basic structure with an annular ring 52 overmoulded onto an insert 54 forming a ballast in order to define a central cavity 56 of shallow but variable depth, for example of the order of 0.25 mm for the chip 60 or of the order of 0.50 mm for the chip 70. For the sake of both economy and further security, in two variants of chips according to the invention, the chips 60 and 70, the generally substantially flat bottom 62 of the cavity 56 is marked by pressure-pad marking (using ink and possibly varnish). The marking is carried out either on the metal or on the plastic in the case of a plastic insert (possibly after applying a primer layer improving the surface finish of the bottom 62). Advantageously, the decoration thus obtained is protected either by one or more layers 64 of transparent covering varnish (chip 60—FIG. 3*b*) or by an adhesive tablet or wafer 65 (not printed) made of strong transparent plastic, for example polycarbonate or polyester, arranged on the decoration 63 which is possibly protected with a varnish (chip 70—FIG. 3*c*). In practice, the varnish option (without wafers) gives the best results from the standpoint of manufacturing cost, security, mechanical strength and wear resistance (in the case of chip 60). In addition, by using a covering sheet of varnish of a suitable thickness (between 50 and 100 μm), for example a sheet obtained by a layer of varnish drop-deposited onto the decoration in the cavity, and/or hard or reinforced varnishes, a wear resistance is obtained which is at least equivalent to that obtained with wafers.

In the case where the chip has a relatively deep cavity (of the order of 0.50 mm), for example for chips with wafers, it is, in addition, advantageous, in order to ensure correct inking of the peripheral region of the bottom 62 of the cavity 56 by the pad, to produce a chamfer 68 on the outside of the straight edge 66 of the cavity 56, the external face of the wafer 65 after it has been mounted ending up substantially at the height of the base of the chamfer 68, as illustrated in FIG. 3*c*. Optionally, provision is also made to modify the shape of the pad in order to adapt it to the shape and depth of the cavity.

It will be easily understood that it is very difficult to bring about a modification or the disappearance of the decoration obtained by pressure-pad marking once it has been coated with its protective layer of varnish, whether for a chip having cavities (for example an "American" chip 60, illustrated in FIG. 3*b* or a chip having cavities without an insert) or a flat chip having a "full face" decoration (for example the chip 16 or the chip 30). It is also possible, by using covering varnishes loaded with various materials, to vary the surface finish of the varnish (and hence of the chip), its visual appearance and/or its feel. In addition to the examples mentioned hereinabove, the varnish of the covering layer may consist of one or more synthetic resins loaded with particles, of varying shape and particle size, of plastic and/or mineral material in order to give the varnish surface a granite-like appearance and/or to increase the coefficient of friction of the latter.

The methods of implementing the invention include one in which a decoration, especially a decoration of the pressure-pad-marked or hologram type, is laid down on the chip and then at least one covering layer of varnish is laid down on top of the decoration. By way of a variant, a decoration is laid down on the chip, especially a decoration of the pressure-pad-marked or hologram type, followed by marking with a coding and/or numbering, incremented or not, by ink-jet or laser printing, hot marking or pressure-pad marking on top of the decoration, and then at least one covering layer of varnish is laid down on top of the decoration and the coding.

We claim:

1. A gambling chip, comprising:

a decoration on at least one face of said gambling chip;

at least one layer of varnish on said decoration including at least one layer of ink applied by pressure pad marking.

2. The gambling chip of claim 1, wherein said decoration is made of polychrome.

3. The gambling chip of claim 1, wherein said ink is at least partially transparent.

4. The gambling chip of claim 1, wherein said varnish is tinted.

5. The gambling chip of claim 1, wherein at least one of said at least one layer of varnish is applied by pressure-pad marking on said at least one face one of below said at least one layer of ink, above said at least one layer of ink, or between layers of said at least one layer of ink.

6. The gambling chip of claim 1, wherein said at least one layer of varnish comprises a material selected from the group consisting of matt varnish, gloss varnish, tinted varnish, varnish with an iridescent appearance, varnish with a nacreous appearance, varnish with a flaky appearance, varnish with a granite-like appearance, varnish with an aged appearance and varnish with a crazed appearance.

7. The gambling chip of claim 1, wherein at least one of said ink and varnish is detectable under ultraviolet light.

8. The gambling chip of claim 1, wherein said at least one layer of varnish includes a top layer of non-stick varnish.

9. The gambling chip of claim 1, further comprising a primer layer on said at least one face below said ink and said varnish.

10. The gambling chip of claim 1, wherein said at least one face is a substantially flat surface having a recess with a substantially flat bottom, at least a portion of said decoration being located in said recess.

11. The gambling chip of claim 10, wherein an edge of said recess has a chamfered shape.

12. The gambling chip of claim 1, wherein said at least one face of the chip has an edge with a softened profile, at least a portion of said edge being stamped simultaneously with said at least one face during pressure-pad marking.

13. The gambling chip of claim 1, wherein said at least one layer of varnish includes a top covering layer having a thickness of at least 20 μm.

14. The gambling chip of claim 13, wherein said thickness is between 50 and 100 μm.

15. The gambling chip of claim 13, wherein said covering layer is formed by one of spraying, dipping, and drop-or curtain-deposition.

16. The gambling chip of claim 13, wherein said covering layer includes at least one synthetic resin with a powder of hard material suspended therein.

17. The gambling chip of claim 16, wherein said hard material is a silica-based material.

18. The gambling chip of claim 13, wherein said covering layer includes at least one synthetic resin having a material suspended therein which increases a coefficient of friction of said covering layer.

19. The gambling chip of claim 18, wherein said material is at least one of elastomer-based and wax-based.

20. The gambling chip of claim 13, wherein said covering layer includes at least one synthetic resin having particles of varying shape and size therein, said particles being at least one of plastic and mineral material.

21. The gambling chip of claim 13, wherein said decoration includes a code marking below said cover layer.

22. The gambling chip of claim 13, further comprising a code on at least one of said at least one face and said at least one edge of said chip below said cover layer, said code being applied by one of ink-jet printing, laser printing, hot marking, and pressure-pad marking.

23. A method for forming a decoration of a gambling chip having at least one face and at least one edge, comprising:

pressure-pad marking at least one layer of ink on at least one of said at least one face and at least one edge; and applying at least one layer of varnish on at least one of said at least one face and at least one edge.

24. The method of claim 23, wherein said applying follows said pressure-pad marking to form a cover layer of varnish, said applying including one of pressure-pad marking, spraying, dipping, or drop-or curtain-deposition.

25. The method of claim 23, wherein said applying applies one of matt varnish, gloss varnish, tinted varnish, varnish with an iridescent appearance, varnish with a nacreous appearance, varnish with a flaky appearance, varnish with a granite-like appearance, varnish with an aged appearance and varnish with a crazed appearance.

26. The method of marking according to claim 23, wherein said applying occurs one of before said pressure-pad marking, after said pressure marking, or between pressure pad marking of two different layers of ink.

27. The method of claim 23, further comprising marking at least one of said at least one face and said at least one edge with a code.

28. The method of claim 27, wherein said marking includes one of ink-jet printing, laser printing, hot marking, and pressure-pad marking.

29. The method of claim 28, wherein said marking follows said pressure-pad marking, and said applying follows said marking to form a cover layer of varnish.

30. The method of claim 23, wherein said at least one edge is softened such that said pressure pad marking simultaneous places ink on one of said at least one face and a portion of said at least one edge.

31. A gambling chip, comprising:

first and second faces and an edge;

said first and second faces and said edge including at least one layer of ink applied by pressure-pad marking, and at least one layer of varnish;

said at least one layer of ink and at least one layer of varnish overlapping to form a pattern.

* * * * *